United States Patent [19]

Borrello

[11] 4,396,521

[45] * Aug. 2, 1983

[54] SOLID DETERGENT SPOTTER

[76] Inventor: Giuseppe Borrello, Viale Palmolive, 18, Anzio, Italy, 00042

[ * ] Notice: The portion of the term of this patent subsequent to Jun. 3, 1997, has been disclaimed.

[21] Appl. No.: 244,456

[22] Filed: Mar. 16, 1981

Related U.S. Application Data

[63] Continuation of Ser. No. 133,710, Mar. 25, 1980, abandoned, which is a continuation of Ser. No. 936,424, Aug. 24, 1978, abandoned, which is a continuation of Ser. No. 679,303, Apr. 22, 1976, abandoned.

[51] Int. Cl.[3] ..... C11D 1/04; C11D 17/00

[52] U.S. Cl. ..... 252/118; 252/90; 252/117; 252/121; 252/122; 252/134; 252/174; 252/DIG. 16; 252/132

[58] Field of Search ..... 252/122, 121, DIG. 12, 252/DIG. 16, 134, 174, 132, 92, 90, 117

[56] References Cited

U.S. PATENT DOCUMENTS

| | | | |
|---|---|---|---|
| 3,417,023 | 12/1968 | DiSalvo | 252/134 X |
| 3,562,167 | 2/1971 | Kamen et al. | 252/134 X |
| 3,664,962 | 5/1972 | Kelly et al. | 252/134 X |
| 3,903,008 | 9/1975 | Deweever et al. | 252/117 X |
| 4,165,293 | 8/1979 | Gordon | 252/118 |
| 4,206,069 | 6/1980 | Borrello | 252/122 |

*Primary Examiner*—P. E. Willis, Jr.
*Attorney, Agent, or Firm*—Norman Blumenkopf; Murray M. Grill; Herbert S. Sylvester

[57] ABSTRACT

A composition for making a water soluble, soft spreadable solid, preferably transparent, detergent article such as a spotting stick comprising a soap component, a synthetic detergent component, an organic non-volatile, high boiling solvent component containing both water soluble and insoluble solvents and water; detergent articles containing such compositions, and methods of making such compositions and articles.

11 Claims, 1 Drawing Figure

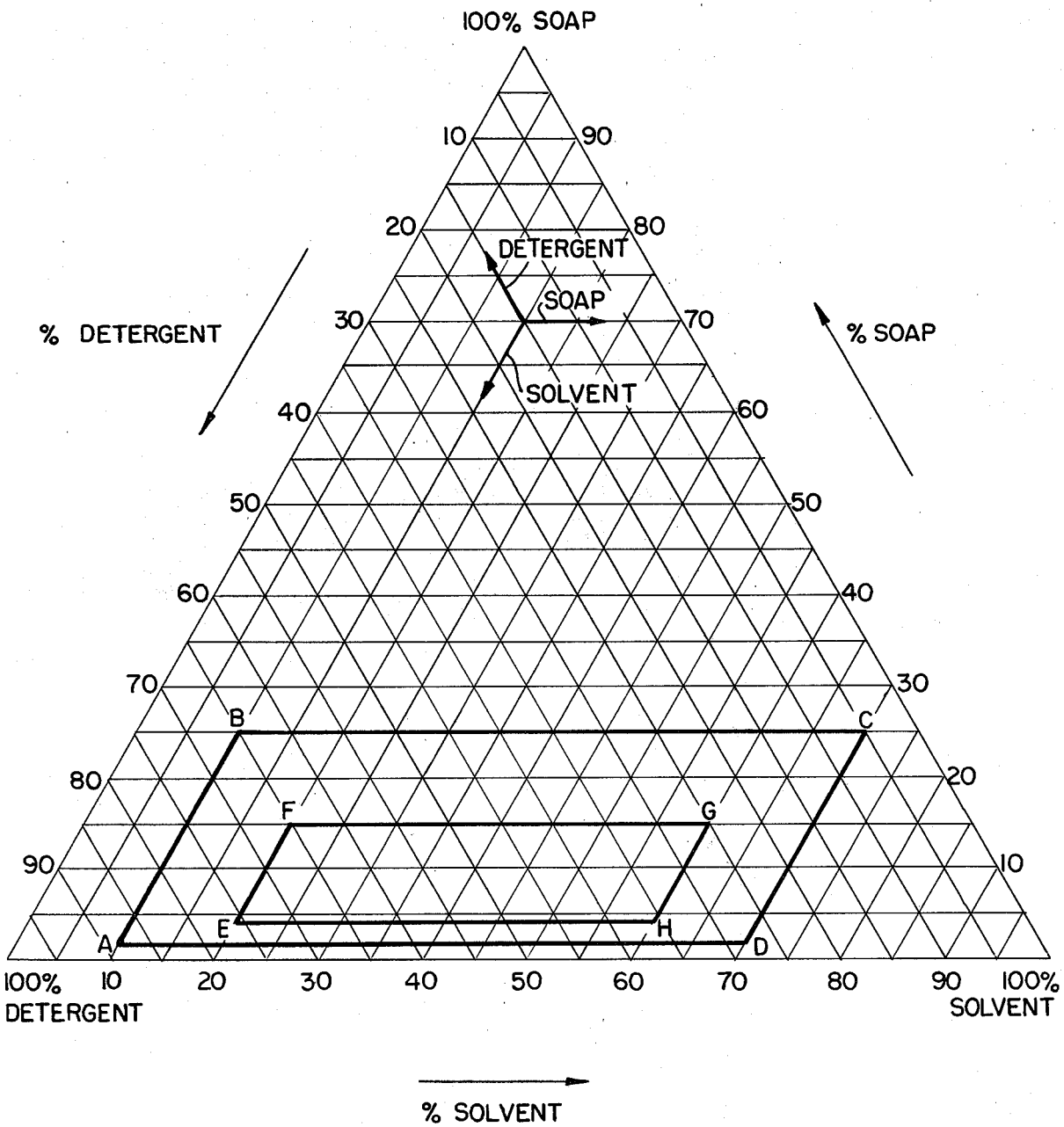
100% SOAP
10
90
20
80
DETERGENT
SOAP
30
70
% DETERGENT
% SOAP
SOLVENT
40
60
50
50
60
40
70
30
B
C
80
20
F
G
90
10
E
H
A
D
100% DETERGENT
10
20
30
40
50
60
70
80
90
100% SOLVENT
% SOLVENT

SOLID DETERGENT SPOTTER

This is a continuation of application Ser. No. 133,710, filed Mar. 25, 1980; which is a continuation of Ser. No. 936,424, filed Aug. 24, 1978 which is a continuation of Ser. No. 679,303, filed Apr. 22, 1976 now all abandoned.

This invention relates to an improved detergent composition, and more particularly to a composition adaptable to forming into a water soluble, soft spreadable, form-stable, solid, optionally transparent detergent article, to the articles made from such composition, and to methods for making such composition and articles.

Transparent soaps, and methods for their manufacture, have been well known and available for a great many years. Being more costly to manufacture, they have been generally regarded as luxury items, and their transparent properties have been equated with high purity and neutrality. Such products have been used almot exclusively in the toilet articles area i.e. bathing, hand and face washing, etc. However, in common with opaque soaps, they are not entirely satisfactory, particularly with respect to their cleansing efficiency in hard water, and/or with respect to some of the synthetic fibrous materials, and/or ease of manufacture, etc.

In U.S. Pat. No. 3,562,167, there is disclosed a composition said to be adaptable for forming transparent detergent bars and cakes useful in hard water. Such composition, bars and cakes and the methods disclosed for their preparation, have been found to be subject to a number of disadvantages. More particularly, the products are highly hygroscopic whereby the resulting bars and cakes readily absorb moisture from the atmosphere, especially under conditions of high relative humidity, become sticky, and lose their transparency. Stickiness is, of course, as in general, objectionable in the compositions of the present invention. Further the products are inferior in water solubility, detergency and stain removal which are of course important properties in a detergent, particularly a detergent spotting stick.

Detergent spotting sticks are likewise known in the art, but are similarly subject to a number of disadvantages. Thus, U.S. Pat. No. 3,417,023 discloses a spotting stick prepared from a composition containing volatile solvents which tend to rapidly evaporate from the detergent stick to eventually leave a hard shrunken product incapable of being spread locally on soiled fibrous or other material unless first moistened with water. Further the resulting detergent stick is insufficiently water soluble, especially in hard water, and insufficiently effective for cleaning certain types of synthetic fibrous materials, soil and water insoluble stains such as ballpoint ink, motor oil, body oils, lipstick, and/or shoe polish and the like. Still further, this patent does not contemplate products which are transparent.

U.S. Pat. No. 3,664,962 discloses a stain removing stick but similarly does not contemplate products which are transparent. It also requires the exclusive use of higher molecular weight, high melting sodium stearate soap and employs too low proportion of synthetic detergent and polyhydric alcohol, which has been found to result in deficiencies in cleaning performance.

It is an object of this invention to provide compositions, shaped detergent articles, and methods for their preparation which will not be subject to one or more of the above disadvantages.

Another object of this invention is the provision of an improved composition adaptable to forming into a water soluble, soft, spreadable, but form-stable solid, shaped detergent article such as a stick, especially useful as a pre-wash spotter.

Still another object of this invention is the provision of such an article which is transparent.

Yet another object of this invention is the provision of a method for making such compositions which avoids the necessity of dissolving a fatty acid soap in hot organic solvent.

A further object of the invention is the provision of detergent composition and soft, spreadable but form-stable, solid, shaped detergent articles which have improved cleaning effects on many different types of soils and stains and of many different types of surfaces, especially artificial such as fabrics or which can be adjusted for improved effectiveness in cleaning particular types of solid, stains and surfaces.

Other objects and advantages will appear as the description proceeds.

The attainment of one or more of the above objects is made possible by this invention which includes the provision of a detergent composition comprising, approximately by weight, I. a matrix comprising A. as a soap component, 2 to 25% of one or more alkali metal, alkaline earth metal (e.g. magnesium, etc.), ammonium or amine salts of fatty acids averaging 6 to 30 carbon atoms per molecule, said soap component providing in the matrix not more than 6% $C_{22}$ and higher soaps, preferably not more than 4.5% and more preferably not more than 3%; not more than 8% $C_{20}$ and higher soaps preferably not more than 6% and more preferably not more than 4%; not more than 20% $C_{18}$ and higher, preferably not more than 18% and more preferably not more than 15%, with the proviso that each of said percents may be raised by a value of 2% for each 1% soap used where the soap is in the form of a potassium soap; and further wherein the soap used has a weighted average carbon content of at least $C_{14}$, the said carbon content insofar as unsaturated moieties are concerned being calculated on the basis of actual carbon content minus 6;

B. As a synthetic detergent component 5% to 88% of at least one anionic organic sulfonate anionic organic phosphate, anionic alcohol sulfate, anionic ether sulfate, or non ionic aliphatic detergent; and C. As a solvent component, 10 to 70% of at least one normally liquid, substantially non volatile organic solvent having a boiling point of at least about 100° C., as further hereinafter defined, and II. a water component (D) constituting 0.1 to 35 parts per 100 parts of said matrix, said matrix and water component being adapted to yield water soluble, form stable, soft, spreadable, solid shaped detergent articles.

The matrix compositions of this invention are set forth in the FIGURE wherein the area bounded by lines connecting points A, B, C and D represents such compositions and the area bounded by lines connecting points E, F, G and H represents preferred matrix compositions.

Such attainment is also made possible by another feature of this invention which includes the provision of a method for preparing the above-defined composition by melting the free fatty acids contained in component A, mixing the molten fatty acids with component C to produce a homogeneous liquid, and admixing therein, at a temperature above the melting point of said free fatty acids and in the presence of components B and D, sufficient alkali metal-, alkaline earth metal-, ammonium-or amine-salt forming bases to saponify and meutralize said fatty acids whereby to form their alkali metal, alkaline earth metal, ammonium or amine salts in situ.

The compositions of this invention are preferably shaped, generally by pouring the molten composition into a removable mold or the package or container in which it is to be dispensed and/or used and permitting the composition to cool and solidify therein, in the form of a stick of any desired size and cross-sectional configuration, e.g. circular, oval, square, rectangular, triangular, hexagonal, etc. Any other shape may however, be produced which may be particularly convenient for an intended use. For example, it may be unsymmetrical or symmetrical, spherical, cubed, egg-shaped, disc-shaped with perimeter of any desired configuration etc. Accordingly, as employed herein and in the appended claims, the term "stick" is intended to include the above shapes and indeed any shape of a transparent, water soluble, soft spreadable solid shaped detergent article. The term "soft" is intended to exclude articles usually regarded as hard or hard-surfaced, referring instead to a firm, solid consistency with a relatively soft surface readily transferable to the locus of the soiled surface, generally textile, whereon the stick is being rubbed, i.e. spreadable. Specific parameters of and methods for determining "softeners" and "spreadability" will be set forth below. Further, since the compositions and sticks of this invention contain a significant proportion of water insoluble solvents, it will be understood that the term "water soluble" herein applied thereto means that the film or layer of such composition locally applied to the soiled area of textile or the like is so readily dispersible in the subsequently employed aqueous detergent laundry bath or system as to be effectively water soluble. By the term "form stable" is meant the physical state of stability of shape under ambient conditions (e.g. 0° C. to about 40° C.; relative humidity from 0% to 100%) whereby the product does not shrink, expand, deform or flow to any significant degree.

In addition to enabling the attainment of the highly desirable esthetic appeal of clear, colourless or coloured transparency, the detergent sticks of this invention have improved properties with respect to water solubility, detergency, solubilization and/or loosening of stains, soils films and other extraneous undesired material on the surface being treated, and/or stability and resistance to changes in consistency, shape, transparency, surface softness ordinarily caused by environmental conditions of heat and humidity, loss of volatile components by evaporation, etc. They are exceptionally effective as pre-wash spotters, i.e. for application to local soiled areas of the textile, plastic or other article being cleaned prior to washing the entire article in any desired aqueous hot or cool laundry detergent bath or system. They may, in fact, be useful as pre-dry cleaning spotters, particularly in view of the relatively high content of organic, water insoluble solvent they may contain.

The compositions of this invention are further especially adaptable to forming into the desired sticks, being formulated to provide optimum fluidity or viscosity properties when melted prior to the stick-shaping step, and to permit the rapid solidification into stick shape considered necessary to achieve the desired transparency. The process of this invention for making such compositions is relatively more simple and expeditious, particularly in employing the more soluble lower molecular weight fatty acids, and neutralizing or saponifying them in situ.

Subject to the limitations discussed below, the fatty acids employed in making the soaps of component A herein may contain about 6 to 30 or more, preferably about 8 to 22, carbon atoms, may be of animal, vegetable, mineral or synthetic origin, and may be saturated or unsaturated, and straight, mono-or polybranched chain hydrocarbon carboxylic acids. As merely illustrative of such acids, there may be mentioned caproic, caprylic, capric, aluric, myristic, stearic, eicosic, oleic, elaidic, isostearic, palmitic, undecylenic, tridecylenic, pentadecylenic, 2-lower alkyl higher alkanoic (such as 2 methyl tridecanoic, 2 methyl pentadecanoic or 2 methyl heptadecanoic) or other saturated or unsaturated fatty acids. Dicarboxylic acids may also be used, such as dimerized linoleic acid. Other higher molecular weight acids as rosin or tall oil acids, e.g. abietic acid, may be employed.

For the attainment of optimum solubility, consistency of product, viscosity, melting and solidifying properties, mixtures or blends of the above and other types of fatty acids are preferably employed containing no more than about 15% of unsaturated fatty acids, no more than about 5% of fatty acids containing more than 18 carbon atoms, and preferably at least about 5% but no more than about 70% of 18 carbon atom fatty acids, preferably stearic acid. One preferred class of fatty acid blends may for example contain about 0–5% of $C_8$, 0–10% of $C_{10}$, 0–30%, of $C_{12}$, 0–20% of $C_{14}$, 10–50% of $C_{16}$, and 5–70% of $C_{18}$ saturated fatty acids. Readily available commercial blends, and mixtures of such blends for obtaining the most suitable distribution of fatty acids, which may be employed include distilled palm and palm kernal oil fatty acids, distilled coconut oil fatty acids, hydrogenated tallow fatty acids, and commercial stearic acid. The fatty acid content, in parts be weight, of several such blends, and mixtures thereof, are illustrated in the following table.

TABLE I

| | a | b | c | d | e | f | g | h |
|---|---|---|---|---|---|---|---|---|
| $C_8$ | — | 4.0 | — | 2.0 | — | 2.0 | 1.3 | 2.7 |
| $C_{10}$ | — | 3.0 | 8.6 | 1.5 | — | 1.5 | 1.0 | 2.0 |
| $C_{12}$ | — | 45.0 | 66.2 | 22.5 | — | 22.5 | 15.0 | 30.1 |
| $C_{14}$ | 3.0 | 19.0 | 25.0 | 11.0 | — | 9.5 | 8.3 | 13.7 |
| $C_{16}$ | 30.0 | 11.0 | — | 20.5 | 50 + 5 | 30.5 | 23.7 | 17.4 |
| $C_{18}$ | 65.0 | 4.0 | — | 34.5 | 43 + 4 | 23.5 | 44.6 | 24.3 |
| Max. Unsat. | 2.0 | 12.0 | — | 7.0 | 4.0 | 8.0 | 5.0 | 8.7 |

In the above table,
blend a = commercial hydrogenated tallow fatty acids
b = commercial distilled coconut oil fatty acids
c = commercial synthetic fatty acids
d = 1:1 mixture of a and b
e = commercial stearic acid
f = 1:1 mixture of b and e
g = 2:1 mixture of a and b
h = 1:2 mixture of a and b For the in situ saponification of these fatty acids according to the process of this invention there may be employed any alkali metal-, alkaline earth metal-, ammonium-, or amine-salt forming base, as for example sodium, potassium, magnesium, or ammonium hydroxides, mono-di- or triethanol-, or -propanol-amines, or any other such base yielding a water soluble salt or soap of the fatty acid being saponified. The base is preferably in the form of a concentrated aqueous solution or dispersion for example of about 20 to 49% concentration, and at about the temperature of the molten fatty acid when admixed therewith. An approximately stoichiometric amount of base is preferably employed unless a product is desired containing slight amounts of excess fatty acid or base.

the component A soap, apart from its known detergency function, contributes body, firmness and nonsticky properties to the detergent sticks of this invention. However, the use of too high a proportion of component A in preparing the products of this invention may unduly raise the melting or fluidizing temperature (to about 110° C. or more), the viscosity of the hot, molten fluid, and the rate of solidification thereof, thereby preventing proper operation of the stick-making process, and tends to unduly reduce the transparency and rate of dissolution of the resulting stick. The use of too low a proportion of component A, on the other hand, unduly reduces the viscosity of the hot, molten fluid and the rate of solidification thereof, in addition to yielding sticks which are too soft and sticky at any level (proportion) of components B and C.

The compositions and sticks of this invention may contain about 2 to 25%, preferably about 4 to less than 15%, and still more preferably about 6 to 12% of component A, of which at least about 40% are preferably or equivalent to the alkali metal salts of hydrogenated tallow fatty acids.

As component B there may be employed substantially any water soluble synthetic organic detergent, or mixtures thereof, of the cationic, amphoteric, anionic sulfonate and sulfate, or non ionic aliphatic types, ample description of which appear in McCutcheon's "Detergents and Emulsifiers", 1969 Annual, and in "Surface Active Agents" by Schwartz, Perry and Berch, Vol. 11, 1958 (Interscience Publishers), which descriptions are incorporated herein by reference.

Suitable cationic detergents include generally the quaternary ammonium compounds which may be described as containing, in addition to the usual halide (chloride, bromide, iodide, etc.), sulfate, phosphate, or other anion, aliphatic and/or alicyclic radicals, preferably aldyl and/or aralkyl, bonded through carbon atoms therein to the remaining 4 available positions of the nitrogen atom, 2 or 3 of which radicals may be joined to form a heterocycle with the nitrogen atom, at least one of such radicals being aliphatic with at least 8, up to 22 or more, carbon atoms. As illustrative of such cationic detergents, there may be mentioned distearyl dimethyl ammonium chloride, stearyl dimethyl benzyl ammonium chloride, coconut alkyl dimethyl benzyl ammonium chloride, dicoconut alkyl dimethyl ammonium bromide, cetyl pyridinium iodide, and cetyl pyridinium iodide, and cetyl trimethyl ammonium bromide and the like.

Suitable amphoteric detergents, combining potentially anionic and cationic groups in one molecular, include the alkyl beta-iminodipropionates and iminopropionates, and long chain imidazole derivatives. Illustrative examples include the disodium salt of lauroylcycloimidinium-1-ethoxyethionic acid-2-ethionic acid, dodecyl beta-alanine, the inner salt of 2-trimethylamino lauric acid, and as zwitterionics, the substituted betaines such as alkyl dimethyl amminio acetates. Several examples of this class of zwitterionics are disclosed in Canadian Pat. No. 696,355.

Suitable anionic water soluble detergents include the alkyl aryl sulfonates, especially the higher (e.g. 10 to 20 or more carbon atom) alkyl benzene sulfonate salt, preferably those alkyl benzene sulfonates wherein the alkyl group contains 10 to 16 carbon atoms. The alkyl group is preferably linear and especially preferred are those of average alkyl chain lengths of about 11 to 13 or 14 carbon atoms, such as the linear dodecyl benzene sulfonate salts.

Preferably also, the alkyl benzene sulfonate has a high content of the 3-alkyl phenyl isomer and a correspondingly low content (well below 50%) of the 2- and 4-alkyl phenyl isomers. One suitable type of such detergent is described in U.S. Pat. No. 3,320,174.

Also, typical of the useful anionic detergents are the olefin sulfonate salts. Generally they contain long chain alkenyl sulfonates or long chain hydroxyalkane sulfonates (with the OH being on a carbon atom which is not directly attached to the carbon atom bearing the —$SO_3$ group). More usually, the olefin sulfonate detergent comprises a mixture of these two types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580; and British Pat. No. 1,139,158, and in the article by Baumann et al. in Fette-Seifen-Anstrichmittel, Vol. 72, No. 4 at pages 247–253 (1970). All the above mentioned disclosures are incorporated herein by reference. As indicated in these patents and the published literature, the olefin sulfonates may be made from straight chain alpha-olefins, internal olefins, olefins in which the unsaturation is in a vinylidene side chain (e.g. dimers of alpha-olefin), etc., or more usually, mixtures of such compounds, with the alpha-olefin usually being the major constituent. The sulfonation is usually carried out with sulfur trioxide under low partial pressure, e.g. $SO_3$ highly diluted with inert gas such as air nitrogen or under vacuum. This reaction generally yields an alkenyl sulfonic acid, often together with a sultone. The resulting acidic material is generally then made alkaline and treated to open the sultone ring to form the corresponding hydroxalkane sulfonate and/or alkenyl sulfonate. The number of carbon atoms in the olefin is usually within the range of about 10 to 25, more commonly about 12 to 20, e.g., a mixture of principally $C_{12}$, $C_{14}$ and $C_{16}$, having an average of about 14 carbon atoms or a mixture of principally $C_{14}$, $C_{16}$ and $C_{18}$, having an average of about 16 carbon atoms.

Another class of water soluble synthetic organic anionic detergents includes the higher (e.g. 10 to 20 carbon atoms) paraffin sulfonates. These may be the primary paraffin sulfonates made by reacting long chain alpha-olefins with bisulfite, e.g., sodium bisulfile, or paraffin sulfonates having the sulfonate groups distributed along the paraffin chain, such as the products made by reacting a long chain paraffin with sulfur dioxide and oxygen under ultraviolet light, followed by neutralization with NaOH or other suitable base (as in U.S. Pat. Nos. 2,503,280; 2,507,088; 3,260,741; 3,372,188; and German Patent 735,096). The hydrocarbon substituent of the paraffin sulfonate preferably contains about 13 to 17 carbon atoms and the paraffin sulfonate will normally be a monosulfonate but, if desired, may be a di-tri- or higher sulfonate. Typically, a paraffin disulfonate may be employed in admixture with the corresponding monosulfonate, for example, as a mixture of mono- and di-sulfonates containing up to about 30% of the disulfonate.

The hydrocarbon substituent of the paraffin sulfonate will usually be linear but branched chain paraffin sulfonates can be also employed. The paraffin sulfonate used may be terminally sulfonated or the sulfonate substituent may be joined to the 2-carbon or other carbon atom of the chain. Similarly, any di- or higher sulfonate employed may have the sulfonate groups distributed over different carbons of the hydrocarbon chain.

Additional water soluble anionic detergents include the higher acyl sarcosinates (e.g., sodium lauroyl sarcosinate) the acyl esters, e.g., oleic acid ester, of isethionates and acyl N-methyl taurides, e.g. potassium N-methyl lauroyl- or oleyl taurides. Another type of anionic detergent is a higher alkyl phenol sulfonate, for example a higher alkyl phenol disulfonate, such as one having an alkyl group of 12 to 25 carbon atoms, preferably a linear alkyl of about 16 to 22 carbon atoms, which may be made by sulfonating the corresponding alkyl phenol to a product containing in excess of 1.6, preferably above 1.8, e.g., 1.8 to 1.9 or 1.95 $SO_3H$ groups per alkyl phenol molecule. The disulfonate may be one whose phenolic hydroxyl group is blocked as by etherification or esterification; thus the H of the phenolic OH may be replaced by an alkyl e.g., ethyl, or hydroxyalkoxyalkyl, e.g., a $—(CH_2CH_2O)XH$ group in which x is 1 or more, such as 3, 6 or 10, and the resulting alcoholic OH may be esterified to form, say a sulfate, e.g., $—SO_3Na$.

Other suitable anionic detergents are $C_{8-20}$ alkyl sulfates such as lauryl sulfate, tallow alcohol sulfate, and alpha- or omega-methoxy octadecyl sulfate, and $C_{8-18}$ alkanoyl mono- and diglyceride sulfates and sulfonates.

Still other suitable anionic detergents are the sulfate esters of non ionic detergents, i.e. the reaction products of about 1 to 20 moles of a $C_{2-4}$ alkylene oxide, preferably ethylene oxide, with 1 mole of $C_{8-24}$ reactive hydrogen-containing compound including aliphatic and alicyclic alcohols such as lauryl, tallow, oxotridecyl, coconut oil, and abietyl alcohols, aliphatic dihydric alcohols such as polyoxypropylenated ethylene and propylene glycols, diamines, and dithiols, aliphatic and alicyclic carboxylic acids such as stearic acid and abietic acid, aliphatic mercaptans such as dodecyl mercaptan, aliphatic and alicyclic amines such as stearyl amine and rosin amine, aliphatic amides such as stearyl amide, and alkyl phenols such as nonyl and dinonyl phenol.

While the aforementioned structural types of organic carboxylates, sulfates and sulfonates are generally preferred, the corresponding organic carboxylates, phosphates (see e.g. U.S. Pat. No. 3,595,968) and phosphonates are also useful as anionic detergents.

Generally, the anionic detergents are salts of alkali metals, such as potassium and especially sodium, although salts of alkaline earth metals, ammonium cations and substituted ammonium cations derived from lower (2 to 4 carbon atoms) alkanolamines, e.g., triethanolamine, tripropanolamine, diethanol monopropanolamine, and from lower (1 to 4 carbon atoms) alkylamines, e.g., methylamine, ethylamine, sec-butylamine, dimethylamine, tripropylamine and triisopropylamine, may also be utilized.

Of the anionic detergents the alkali metal salts of sulfated and sulfonated moieties are preferred over the carboxylic, phosphoric and phosphonic compounds.

Aliphatic nonionic detergents operative as or in component B may be described as reaction products of about 2 to 50 moles of a $C_{2-4}$ alkylene oxide, preferably ethylene oxide, with 1 mole of a $C_{8-24}$ reactive hydrogen-containing aliphatic compound, illustrative of which aliphatic compounds are those reactive hydrogen-containing compounds discussed above as precursors of sulfate esters of non ionic detergents which are aliphatic.

Preferred nonionics surfactants are those represented by the formula:

$$RO(C_2H_4O)_nH$$

wherein R represents the residue of a saturated straight or branched chain aliphatic alcohol, preferably a primary alkanol of about 8 to 20, preferably about 12 to 18 carbon atoms and n is an integer from about 2 to 50 preferably about 3 to 20.

Typical commercial non ionic surfactants suitable for use in the invention include an ethoxylation product having an average of 11 ethylene oxide units of a 14 to 15 carbon atom chain fatty alcohol; a 12 to 15 carbon atom chain fatty alcohol ethoxylated with an average of 7 ethylene oxide units; a 16 to 18 carbon alkanol ethoxylated with an average of 10 to 11 ethylene oxide units and such products being variously, or substantially equivalent to the reaction products of 11 moles of ethylene oxide (E.O.) with 1 mole of a $C_{14-15}$ primary alkanol or 1 mole of $C_{12-15}$ primary alkanol, of 7 moles E.O. with 1 mole of a $C_{12-15}$ primary alkanol, and 3:1 to 1:3 blends of the reaction product of 20–50 moles E.O. with 1 mole of a $C_{16-18}$ primary alkanol, and of 3–5 moles E.O. with 1 mole of $C_{9-10}$ alkanol.

Other suitable non ionic aliphatic detergents include the liquid and semi-solid reaction products of 3–20 moles E.O. with 1 mole of $C_{11-15}$ secondary alkanols, the Pluronics, and the reaction products of 5–7 moles E.O. with 1 mole of $C_{16-18}$ alkane diols.

Still other suitable aliphatic non ionic detergents are those of the polar type which can also serve to enhance lathering and cleaning properties of other types of detergents, particularly anionic detergents. In a polar type non ionic detergent, the hydrophilic group contains a semi-polar bond directly between 2 atoms, e.g. $N\rightarrow O$, $P\rightarrow O$, $As\rightarrow O$, and $S\rightarrow O$, the arrow being the conventional representation of a semi-polar bond. There is charge separation between the 2 directly bonded atoms, but the molecule bears no net charge and does not dissociate into ions. Illustrative types are amine oxides of the formula $R^2R^2R^3N\rightarrow O$ and phosphine oxides of the formula $R^2R^2R^3P—O$ wherein $R^1$ is $C_{10-18}$ alkyl, alkenyl or alkanol and $R^2$ and $R^3$ are independently $C_{1-3}$ alkyl or alkanol, for example dodecyldimethyl amine and phosphine oxides.

As indicated above, mixtures of the above described detergents may be employed as component B. A preferred embodiment is the use of at least about 40% up to 100%, of the non ionic reaction product of about 2 to 50, preferably about 5 to 15 moles of ethylene oxide with 1 mole of ethylene oxide with 1 mole of a saturated aliphatic alcohol, preferably a primary alkanol, of about 8 to 20, preferably about 11 to 16, carbon atoms, as or in component B.

The detergents of component B contribute improved hard water solubility and improved detergency to the compositions and sticks of this invention, particularly in hard water and/or with respect to the synthetic fibrous materials such as nylon, polyesters such as Dacron and polyacrylonitriles such as Orlon and Acrilan. They also increase the water solubility and rates of wetting and dissolution of such compositions and sticks. This component B should contain little or no mineral salts, a fairly common ingredient of commercial detergent formulations, to minimize effects on the transparency properties of the products, and may be employed in the compositions and sticks of this invention in amounts ranging from about 5 to 88%, preferably about 25 to 76% by weight, most preferably 35 to 76%.

A major portion (≧50%) and preferably from 75 to 100% of the component C solvent should be normally liquid, i.e. with a solidification point (S.P.) below about 40° C., preferably below room temperature, and a boiling point of at least about 100° C., preferably at least about 120° C., up to about 400° C. It should be substantially non-volatile, with a negligible vapour pressure at room temperature and negligible loss by evaporation on ageing or storage. Thus, particularly good non-volatility is indicated by a loss of weight of 5% or less after 2 hours at 105° C. or after 10 hrs. at 43° C. for a 20 grams sample of the solvent in a container with an evaporating surface of about 46.5 sq. cm. (2.3 sq. inches) placed in an oven provided with a flow of air.

Of the said non-volatile fraction of said component C at least about 10% should be water insoluble (e.g. benzyl alcohol) to provide 10% thereof in component (C) and preferably at least 25% up to 100%. One or more substantially water soluble organic solvents, such as propylene glycol may constitute a part of the non-volatile fraction in an amount no more than about 90% preferably not more than 75%, and still more preferably not above about 50% by weight of said fraction. The preferred water-soluble solvent should contain a dihydric alcohol, such as propylene glycol.

As a suitable substantially water insoluble organic solvent, benzyl alcohol is preferred, or lauryl alcohol or terpineol, but as illustrative of other such solvents which may be employed in or as component C, there may be mentioned, as a rule of thumb, any such liquid more water insoluble than benzyl alcohol, including generally any substantially water insoluble aliphatic, alicyclic or aromatic liquid hydrocarbon, halogenated (iodine, bromine or preferably chlorine) hydrocarbon, hydroxylated hydrocarbon, ether, ester, or the like having the above-described properties, for example octane, hexadecane, chlorohexane, chloro- and dichloro-benzene, heptyl, Oxotridecyl and hexadecyl alcohols, abietyl alcohol, octanediol, phenethyl alcohol, mono- and di-$C_{1-14}$ alkyl phenols, phenyl ether, benzyl ether, 1,2-dibutoxy benzene, 2-benzyloxy-ethanol, butyl ether, diethyl- and dibutyl-phthalates, benzyl propionate, isopropyl myristate, palmitate, and stearate, and the like. Benzyl Alcohol is also unique (with others) in providing body and form-stability to the matrix products.

Similarly, as a rule of thumb, the substantially water soluble solvent in or as component C may be any such solvent which is more water soluble than benzyl alcohol. It may be of any type chemically, but is generally a mono hydric or polyhydric alcohol, ether alcohol, or amine such as 1,7-heptanediol, the mono- and polyethylene and -propylene glycols of up to about 4000 molecular weight, and the mono-$C_{1-14}$ alkyl ethers thereof, sorbitol, glycerol, glucose, diglycerol, sucrose, lactose, dextrose, 2-pentanol, 1-butanol, mono-, di- and triethanolamine, 2-amino-1-butanol, and the like, especially the polyhydric alcohols and alkanolamines.

As pointed out the solubility of benzyl alcohol (reported 4 g. per 100 ml. of water at 170 C.) is taken as a general guide for selecting water-soluble and water insoluble solvents. As a further guide, a solvent may be considered water insoluble if its solubility in water at 20° C. is less than about 10% by weight and preferably less than about 5% by weight.

Operable ratios of water-insoluble to water-soluble solvents will fall within the range of 10:1 to 1:10 preferably 10:1 to 1:5, and more preferably 8:1 to 1:3. Other preferred ratios are 5:1 to 1:3 and 4:1 to 1:2.

The solvent Compenent C is essential for the production of sticks which are transparent and further functions as a coupling or mutual solvent for the component A soap and its fatty acid precursor, and the component B detergent. It also fluidizes the melt and facilitates the shaping thereof into sticks which solidify rapidly on cooling in accordance with the process of this invention. It further improves the surface softness and solubility of the stick products. The use of substantially all water soluble solvents in component C while good mutual or coupling solvents for components A and B, and good water solubilizers of the stick products, tend to unduly increase the softness, tackiness and hygroscopicity thereof, particularly those of the polyhydric alcohol type, in storage and use. Such tendencies are controlled in accordance with this invention by limiting the proportions of water soluble solvents and employing water insoluble solvents in component C as described above, in addition to the other functions performed by such insoluble solvents. It should however, be noted that a controlled degree of hygroscopicity in the products hereof may be beneficial in preventing such products from drying out, shrinking and cracking in storage and use. Component C, like Component B, should of course also be stable or resistant to the action of the base or alkaline material used in making the component A soap in situ according to the process of this invention.

Component C should generally constitute no more than about 70%, preferably no more than about 60%, still more preferably less than about 50%, of the composition and sticks of this invention to avoid unduly reducing the detergency properties thereof because of the resulting lower proportions of components A and B, and to avoid unduly increasing the sweating (liquids leakage), hygroscopicity, softness, and tackiness of the sticks. In general, the compositions and sticks of this invention may contain approximately by weight, 10 to 70, preferably 20 to 60, and more preferably 20 to less than 50% of component C.

Water component D contributes to a lowering of the viscosity of the present compositions in the fluid or molten state, and facilitates neutralization of the fatty acid precursors of the component A soaps in the processes for making the sticks and compositions of this invention, in addition to assisting in solubilizing components A and B. Further, some if not all the water is conveniently introduced in the form of an aqueous solution of the base of alkaline material employed in the in situ neutralization or saponification of the fatty acid precursors of the component A soap. Water also increases the water solubility and transparency of the sticks of this invention and its partial loss from the sticks by evaporation during ageing and storage, particularly from the outer layers of the sticks, is balanced by, the hygroscopic tendencies of other components, especially polyhydric alcohols in Component C. Too low a proportion of water detrimentally affects the workability of the present compositions and the transparency of the resulting sticks. Too high a proportion unduly reduces the rate of solidification of these compositions into sticks, and unduly increases the stickiness and softness thereof.

In general, the compositions and sticks of this invention should contain, approximately by weight, 1 to 25 parts, preferably 5 to 15 parts, and more preferably 5 to 10 parts, of water component D, and may further contain minor proportions, for example a total of from 0 up to about 5 or 10%, of common additives including colouring materials such as dyes, brighteners or optical dyes, preservatives, UV absorbers, stabilizers, perfumes, disinfectants, foaming and lathering agents, enzymes fillers, sequestrants, soil suspending agents, anti-redeposition agents, and the like. Fillers and builders can, likewise, be added in any convenient amounts (e.g. 1–85%). Sodium sulfate is a usual filler with the phosphates, carbonates, borates, and selecates as illustrative inorganic builders. Among the latter, sodium trepoly phosphate is the usual choice. Organic builders such as trisodium nitrilotriacelate, hydroxyethyliminodiacetic acid, sodium salts, citrates, gluconates, and the like are useful. Polyelectrolytes, and sequestration agents can also be used in any desired amounts.

According to the process for preparing the compositions of this invention, it is preferred to melt the free fatty acids corresponding to the soaps of component A in a heated vessel, mixing in components B and C, and gently stirring the mixture at a temperature above, but preferably no more than about 30° C. Above more preferably about 2° to 15° C. above the melting point of the said fatty acids (usually about 70° to 80° C.) until a homogeneous liquid is obtained. A solution of the selected salt forming base in water component D, preferably at the temperature of said homogeneous liquid, is then mixed therein, preferably gradually and/or in small increments to avoid lumps and overheating, until the in situ neutralization and/or saponification of the fatty acids in the said liquid is complete. Desirably, an approximately stoichiometric amount of the base is employed to avoid excess base or fatty acids in the product. Neutralization of the product can be ascertained for example by periodic testing with phenolphthalein indicator. If desired the detergent component B may be first dissolved in the heated solvent component C and the resulting solution filtered to remove mineral salts and any other undissolved material prior to mixing the B and C components, in the form of the resulting hot clear solution, into the molten acids.

After all the base has been added and the resulting hot liquid product mixed sufficiently until it is determined that the acids are neutralized, any desired minor amounts of the above described known additives to detergent formulations are mixed in together, if desired with any desired additional amounts of water component D. Alternatively, some of the water component D may be added together with detergent components B and/or solvent component C.

In some instances, it may be desirable and within the scope of this invention to replace up to about 75% or more of the initially melted free fatty acids by their corresponding soaps or salts, e.g. neat or kettle soap, with of course a corresponding reduction in the proportion of soap-or salt-forming base subsequently mixed with the hot melt to neutralize or saponify the free fatty acids therein.

According to another embodiment of the invention, when a product is being prepared containing a heat sensitive anionic organic sulfonate or alcohol sulfate detergent as or in component B, such detergent is not mixed with the molten fatty acids prior to the exothermic neutralization reaction thereof with the base, but is instead subsequently mixed into or with the previously neutralized and cooled liquid (to just above the solidification point of the said liquid containing the soap or fatty acid salt component A, the solvent component C, and any remaining detergent portion of component B.

The hot melt liquid composition of the invention produced as described above may if desired be cooled and solidified in bulk or any other desired form. According to a further feature of this invention, such cooled and solidified composition is remelted, or more preferably said hot liquid composition is employed without, such intermediate cooling, solidification, and remelting steps with attendant possible loss of components by decomposition and/or evaporation, but is instead directly poured into molds, packages or containers of the desired shape, and size, e.g. sticks, and cooled to below the solidification point. The improved water soluble, soft, spreadable, solid optionally transparent detergent sticks of this invention are thereby produced and may if desired be aged a short time to permit equilibrium with the environment.

The matrix products of this invention provide an unique combination of both physical and chemical characteristics. As pointed out above they are generally transparent, stable, soft, spreadable, solid form-stable materials which exhibit excellent detergency in a clothes laundering process and have excellent solubility characteristics particularly in the washing machine.

The products of this invention generally have a soil removal ability comparable, if not superior to presently used clothes laundering detergents. The detergency is conveniently measured by both the standard tergotometer (U.S. Testing Company, Hoboken, N.J. U.S.A.) test and with practical machine washes. In the Tergotometer test an aqueous solution of detergent (0.1–0.5% concentration) is stirred with soiled swatches (and usually with clean swatches as well as for redeposition effectiveness) and the detergency is then conveniently determined by "before" and "after" readings on a Colour Difference meter (e.g. Gardner Colour Difference Meter). The test may be run at any temperature (generally room temperature to the boil) with stirring at from 0–250 rpm, for 5–20 minutes (conveniently 10 minutes) at water hardnesses from 0 to 300 or more ppm (as $CaCO_3$). Prior to the "after" readings, the cleansed swatches are rinsed for a few minutes in the same hardness water as used in the detergency step, dried and then evaluated.

The products of this invention also are outstanding for use on various stains e.g. grease, oily soil, lipstick, ball point ink, etc. The dissolution speed of the products of this invention are measured in water at from room temperature to the boil (generally and conviently at 40° C.). The method is generally to add 2 grams of product to 500 ml. of water at a selected temperature and stir at selected standardized conditions until all the product is dissolved, The procedure, specifically is to use a 600 ml beaker of 12 cm height and 8.5 cm in diameter (very flat bottom) graduated every 50 ml. Place the 500 ml water in the beaker, set the temperature add 2 grams of product and stir. The stirring is effected by means of a magnetic stirrer which is a cylindrical bar having a 1 mm. plastic coating. The overall dimensions of the bar are 12 mm diameter and 6.2 mm in length. The speed of rotation is adjusted to give a vortex with its apex at the 300 ml graduation of the beaker.

The products of this invention have dissolution speeds when measured as aforedescribed of from ½ to 5 mins. at 40° C.

The penetration hardness of the products of this invention can be measured by means of the ASTM Method D217-52T (Richardson Method). Values obtained for the matrix products of this invention vary from about 70 to about 120 (tenths of a millimeter).

The product stickiness (also spreadability and transferability by rubbing) is determined by rubbing under a 2 kg weight a molded 1" cylinder of product on a standard cotton cloth and (10 cm. long) and measuring the amount of product released by frication as the cloth is pulled under the weighted cylinder. Suitable products have friction values (translucent factors) of about 100 mg. to about 300 mg. of product per 10 cm. strip of cotton cloth. Preferred products have transferability factors of from above 150 to less than about 300.

The product transparency is conviently measured by means of a lamp/photocell/galvanometer system, reading the percentage of transmitted light after a zero adjustment. Spectrocolorimeters can also be used. Substantially total transparency (i.e. ≧95%) can be achieved with the products of this invention.

Other relevant parameters of the products of this invention are the solidification temperature (S.P.) and viscosity of the product in the fluid state since these are important considerations in processing the instant compositions particularly into the sahped forms hereinbefore described. These parameters have a direct effect on rate of production, size and handling of such shaped forms (e.g. sticks) as well as affecting the transparency and stickiness of the final product. Generally, the S.P. of the matrix products of this invention range from about 40° C. to 100° C. and the viscosity, as measured by a falling ball visometer, may range from about 50 cps to 3000 cps with most suitable values in the range of about 1000–2000 cps. The following examples are not limitative and are only illustrative of preferred embodiments of this invention. All amounts and proportions herein are by weight and unless otherwise indicated.

EXAMPLE 1

| | Parts |
|---|---|
| Formulation 1 | |
| Hydrogenated tallow fatty acids | 12.5 |
| Benzyl alcohol | 20.0 |
| Propylene glycol | 30.0 |
| Non ionic $C_{14-15}$ alkanols + 11 E.O. | 28.0 |
| Formulation 11 | |
| Deionized water | 5.0 |
| Low chloride 38% aqueous NaOH | 4.1 |
| Formulation 111 | |
| Pigmosol Blue 5G - 1% aqueous solution | 0.4 |

*Reaction product of 1 mole of $C_{14-15}$ alkanols with all moles of ethylene oxide.

The ingredients of Formulations 1 and 11 are separately heated in a mixing tank to 80°–85° C. with good agitation until homogeneous, and the Formulation 11 mixture slowly added with agitation to Formulation 1. A few drops of phenolphthalein indicator are then added to the mixture and if the mixture is till colourless, small increments of the NaOH solution are added till the mixture just turns pink. The Formulation 111 colour is then mixed in, and the mixture held at about 71° C. while being poured into stick molds. The sticks are solidified by cooling carefully and slowly to ensure transparency of the sticks.

The resulting transparent, water soluble, readily spreadable detergent sticks are highly effective for removing ball pen ink stains, cuffs and collar discolourations, etc. when the stained or soiled areas are rubbed with the sticks and then washed in an aqueous laundry detergent bath. The sticks are stable to varying environmental conditions for extended periods of time.

EXAMPLE 2

The procedure of Example 1 is repeated with the following formulations, the results being nearly equal:

| | Parts |
|---|---|
| Formulation 1 | |
| Hydrogenated tallow fatty acids | 10.00 |
| Benzyl alcohol | 28.65 |
| Propylene glycol | 28.65 |
| Non ionic $C_{14-15}$ alkanols + 11 E.O. | 28.00 |
| Formulation 11 | |
| Deionized water | 4.50 |
| 35% aqueous NaOH | 4.40 |
| Formulation 111 | |
| Pigmosol Blue 5G - 1% aqueous solution | 0.10 |
| optiblanc BT11* | 0.10 |
| optiblanc 2MG* | 0.10 |

*6% solution of each optical brightener, freed of mineral salts, in 1:1 benzyl alcohol:propylene glycol.

EXAMPLE 3

Examples 1 and 2 are repeated except that the nonionic detergent in Formulation 1 is replaced by an equal amount of the following detergents:

(A) Cationic distearyl dimethyl ammonium chloride (B) 1:1 mixture of (A) and $C_{14-15}$ alkanols+11 E.O.

(C) Anionic sodium $C_{14-17}$ paraffin sulfonate (100% active, pure, desalted)*

*Added as a 66.5% solution in 1:1 benzyl alcohol: propylene glycol.

(D) 1:1 mixture of (C) and $C_{14-15}$ alkanols+11 E.O.

The results are similar to those of Examples 1 and 2. When (C) is employed, it may alternatively be included in Formulation 111 instead of 1.

In the following examples set forth in table 11 the parts of ingredients are set and the identification thereof given in table 1. The procedure of Example 1 is followed in preparing each of the compositions.

TABLE 1

| INGREDIENTS | |
|---|---|
| COMPONENT A | |
| A1 | Hydrogenated tallow fatty acids |
| A2 | Distilled coconut oil fatty acids |
| A3 | Distilled tallow fatty acids |
| A4 | $C_{11-13}$ Synthetic fatty acids |
| A5 | $C_{22}$ Fatty acids |
| A6 | Commercial stearic acids |
| A7 | Neat soap (15:85 A2 soap:A3 soap + 33% water) |
| A8 | Soap noodles (85/15 tallow coconut & 12% water) |
| COMPONENT B | |
| B1 | Nonionic reaction product of 1 mole of $C_{14-15}$ primary alkanols with about 11 moles of ethylene oxide (+ 11 E.O.) |
| B2 | Nonionic $C_{12-15}$ primary alkanols + 11 E.O. |
| B3 | Nonionic $C_{12-15}$ primary alkanols + 7 E.O. |
| B4 | Nonionic $C_{9-11}$ primary alkanols + 5 E.O. |
| B6 | Nonionic $C_{11-15}$ secondary alkanol + 3 E.O. |
| B7 | Nonionic $C_{16}$ alkanediol (omega omega) + 5 E.O. |
| B8 | Anionic sodium $C_{10-14}$ (av. dodecyl) alkyl benzene sulfonate. |
| B9 | Anionic sodium sulfate of lauryl alcohol + 3 E.O. |

TABLE 1-continued

| INGREDIENTS | |
|---|---|
| B10 | Anionic sodium $C_{14-17}$ paraffin sulfonate |
| B11 | Anionic sodium lauryl sulfate |
| B12 | Nonionic $C_8$ primary alcohol + 2. E.O. |
| B13 | Nonionic $C_{12-14}$ primary alcohol + 2. E.O. |
| B14 | Pluronic L-61 |
| B15 | Nony phenol + 9.5 E.O. |
| B16 | $C_{16-18}$ olefin sulfonate |
| B17 | Nonionic $C_{11-15}$ secondary alcohol + 5 E.O. |
| B18 | Nonionic $C_{11-15}$ secondary alcohol + 7 E.O. |
| B19 | Nonionic $C_{11-15}$ secondary alcohol + 9 E.O. |
| COMPONENT C | |
| C1 | Benzyl alcohol |
| C2 | Lauryl alcohol |
| C3 | Terpineol |
| C4 | Diethyl phthalate |
| C5 | Phenethyl alcohol |
| C6 | Propylene glycol |
| C7 | Ethylene glycol monoethyl ether |
| C8 | Diethylene glycol |
| C9 | Triethylene glycol |
| C10 | Polyethylene glycol M.W. 3000 |
| C11 | Triethanolamine |
| C12 | Glycerine |
| C13 | Dipropylene glycol |
| COMPONENT D | |
| D1 | 35% aqueous caustic soda solution |
| D2 | Deionized water |
| D3 | 49% aqueous caustic soda solution |
| D4 | 50% aqueous caustic potash solution |
| ADDITIVES E | |
| E1 | Optical dye, e.g. |
| E2 | Dye, e.g. Pigmasol Blue 5G |
| E3 | Perfume |

TABLE II

| | EXAMPLES COMPONENTS - PARTS BY WEIGHT | | | | |
|---|---|---|---|---|---|
| EXAMPLE | A | B | C | D | ADDITIVES |
| 4 | 15A1 | 15B1<br>20B17 | 20C1<br>20C6 | 5D2<br>4.9D3 | |
| 5 | 10A1 | 20B1<br>20B18 | 20C1<br>20C6 | 5.D2<br>3.3D3 | |
| 6 | 8.5A1 | 26.5BA | 23.5C1<br>23.5C10 | 10D2<br>2.9D3 | |
| 7 | 10.6A1 | 27B19 | 23.5C1<br>23.5C10<br>9.4C12 | 10D2<br>3.2D3 | |
| 7A | 10A1 | 20B4<br>20B14 | 15C1<br>5C6<br>15C10 | 1.7D2<br>3.3D3 | |
| 8 | 8A6 | 20B1<br>20B18 | 20C1<br>20C6 | 2D2<br>2.7D3 | |
| 9 | 10A1 | 35B1 | 25C1<br>23C6 | 3D2<br>3.303 | .003E2 |
| 10 | 10A1 | 28B10 | 28.6C1<br>28.6C6 | 4.4D3 | .004E2 |
| 11 | 12.5A1 | 15B1<br>20B8 | 22.5C1<br>22.5C6 | 6D2<br>4.1D3 | .004E2 |
| 12 | 10A1 | 30B1 | 56C1 | 2D2<br>4.1D3 | |
| 13 | 10A1 | 35B1<br>10B6 | 20C1<br>5C6<br>10C11 | 5D2<br>3.5D3 | |
| 14 | 7A1<br>7A2 | 16B1<br>5B12<br>5B15 | 25C1<br>25C6<br>5C11 | 5D2<br>5D3 | |
| 15 | 11A1<br>11A2 | 42.2B10 | 11.4C1<br>11.4C6 | 10.5D3 | |
| 16 | 11A1<br>11A2 | 45.2B1 | 11.4C1<br>11.4C6 | 10.5D3 | |
| 17 | 11A1<br>11A2 | 45.2B8 | 11.4C1<br>11.4C6 | 10.5D3 | |
| 18 | 11A1<br>11A2 | 35.2B1<br>10B8 | 11.4C1<br>11.4C6 | 10.5D3 | |
| 19 | 7A6 | 18B1<br>16B10 | 26.7C1<br>26.7C6 | 2D2<br>3D3 | .002E2<br>.02E1 |

TABLE II-continued

| | EXAMPLES COMPONENTS - PARTS BY WEIGHT | | | | |
|---|---|---|---|---|---|
| EXAMPLE | A | B | C | D | ADDITIVES |
| 20 | 8A1 | 16B6<br>13.3B10 | 19.3C1<br>19.3C6 | 3.6D1<br>2D2 | .004E2<br>.12E1 |
| 21 | 9A1 | 25B9 | 27.9C1<br>27.9C6 | 3.2D1 | .02E1<br>.004E2<br>.3E3 |
| 22 | 8A6 | 35B2 | 25C1<br>25C8 | 2D2<br>2.8D3 | .002E2 |
| 23 | 3.5A1<br>3.5A2<br>3.5A3 | 33B1 | 26C1<br>26C6 | 5.1D1 | |
| 24 | 3A1<br>15A7 | 28B1 | 26C1<br>26C6 | 1.2D1 | |
| 25 | 3.5A1<br>3.5A2<br>3.5A3 | 33B1<br>12B10 | 20C1<br>20C6 | 5D1 | |
| 26 | 8A6 | 48B2 | 20C1<br>20C6 | 2.8D2<br>2D3 | .005E1<br>.001E2<br>.3E3 |
| 27 | 8A6 | 48B2 | 20C1<br>20C6<br>5C7 | 2.8D2<br>2D3<br>1D4 | .005E1<br>.001E2<br>.03E3 |
| 28 | 8A6 | 20B2<br>20B13<br>10B10 | 15C1<br>10C6<br>15C7 | 4D1<br>1D4 | |
| 29 | 8A6 | 20B2<br>10B10<br>20B13 | 15C1<br>10C6<br>15C7 | 4D1<br>5D2<br>1D4 | |
| 30 | 7A1<br>7A2 | 5B1<br>5B8 | 37.5C1<br>37.5C6 | 7D1 | |
| 31 | 10A1 | 14B1<br>14B10 | 24.6C1<br>20.8C6 | 4.4D1<br>2.4D2 | .002E1<br>.001E2<br>.3E3 |
| 32 | 10A1 | 28B2 | 28.6C2<br>28.6C6 | 3.2D1 | .001E1<br>.004E2<br>.3E3 |
| 33 | 10A8 | 50B2 | 20C1<br>20C6 | .5D1 | |
| 34 | 4A6<br>5A8 | 50B2 | 20C1<br>20C6 | 2.7D1 | .005E1<br>.003E2<br>.35E3 |
| 35 | 10A8 | 50B2 | 20C1<br>8C6<br>12C13 | .5D1 | .005E1<br>.003E2 |
| 36 | 6A6<br>10A4 | 20B2 | 28C1<br>28C6 | 8D1 | .004E1<br>.002E2<br>.35E3 |
| 37 | 6A6<br>10A4 | 20B2 | 14C1<br>14C4<br>28C6 | 8D1 | .004E1<br>.002E2<br>.35E3 |
| 38 | 6A6 | 20B2<br>10B16 | 30C1<br>30C6 | 3D1<br>7D2 | .004E1<br>.002E2<br>.35E3 |
| 39 | 5A5 | 65B1 | 15C1<br>15C6 | 1.7D1 | |
| 40 | 10A5 | 50B1<br>5B11 | 20C5<br>15C6 | 3.3D4 | |
| 41 | 12A1 | 40B3<br>15B7 | 22C3<br>15C9 | 6D2<br>4D3 | |
| 42 | 12.5A1 | 28B1 | 20C1<br>30C6 | 4D1<br>5D2 | |
| 43 | 3A6<br>1A5 | 70B1 | 20C1<br>6C6 | 1.3D1<br>2D2 | |
| 44 | 5A1 | 37.5B1<br>37.5B19 | 15C1<br>5C6 | 1.7D1<br>2.5D2 | |
| 45 | 10A1 | 70B2 | 15C1<br>5C6 | 5.1D1<br>2D2 | |

EXAMPLE 46

Examples 1, 2 and 3 are repeated with similar results, when the hydrogenated tallow fatty acids in Formulation 1 are replaceably.

(A) Distilled coconut oil fatty acids (B) 1:1 mixture of (A) and hydrogenated tallow fatty acids (C) Commercial stearic acid
(D) 1:1 mixture of (A) and (C)
(E) Palmitic acid
(F) 1:1 mixture of (E) and hydrogenated tallow fatty acids

EXAMPLE 47

Examples 1–4 are repeated, with similar results, when the benzyl alcohol is replaced by an equivalent amount of phenethyl alcohol and the propylene glycol by an equivalent amount of polyethylene glycol, M.W. 3000.

The products of all the foregoing examples are acceptable with most being excellent if not outstanding.

This invention has been disclosed with respect to preferred embodiments thereof and it will be understood that modifications and variations thereof will become obvious to those skilled in the art and which are to be included within the spirit and purview of this application and the scope of the appended claims.

I claim:

1. A detergent composition comprising;

(1) A matrix of (A) soap, (B) synthetic detergent, and (C) solvent component; the soap compenent (A) constituting from 4–15% by weight of the matrix comprising water soluble alkali metal, alkaline earth metal, ammonium or amine salt of a $C_6$–$C_{30}$ fatty acids said soap component providing in the matrix not more than about 14% of salts of fatty acids of more than 18 carbon atoms and not more than 20% of salts of $C_{18}$ or greater fatty acids and with the further proviso that when potassium soap is present the total soap may be increased to twice the soap used in the potassium salt form and wherein the soap has a weighted average carbon content of at least $C_{14}$; the synthetic detergent component (B) constituting from 25 to 76% by weight of the matrix and comprising at least one water soluble member of the group consisting of (1) anionic $C_{10}$ to $C_{20}$ alkyl benzene sulfonates (2) anionic $C_{10}$ to $C_{25}$ olefin sulfonates, (3) anionic $C_{10}$ to $C_{20}$ paraffin sulfonates, (4) anionic $C_8$ to $C_{20}$ alcohol sulfates, (5) anionic sulfate and phosphate esters having the molecular configuration of the reaction product of 1 to 20 moles of a $C_2$ to $C_4$ alkylene oxide with (A) $C_8$ to $C_{24}$ aliphatic or alicyclic acid, mono- and dihydric alcohol, mono- or diamine or monocarboxylic acid, or aliphatic amide or mercaptan, (6) anionic $C_8$ to $C_{18}$ alkanoyl mono- and diglyceride sulfates and sulfonates, (7) anionic higher acyl sarcosinates, higher acyl N-methyl taurides, (8) anionic $C_{12}$ to $C_{25}$ phenol disulfonates, (9) aliphatic nonionic compounds having the molecular configuration of the reaction product of 2 to 50 moles of a $C_2$ to $C_4$ alkylene oxide per mole of a $C_8$ to $C_{24}$ reactive hydrogen-containing aliphatic compound, but a maximum of about 50% when the synthetic detergent component consists only of anionic organic sulfonates or anionic alcohol sulfates or mixtures thereof; and the solvent component (C) constituting from 20 to less than 50% by weight of the matrix and comprising at least one normally liquid, substantially non-volatile organic solvent having a boiling point of at least 100° C. at least 10% of component (C) being water-insoluble; and (2) a water component (D) constituting from 5 to 15 parts per 100 parts of matrix (1) said detergent composition being characterized by a dissolution speed of ½ to 5 minutes at 40° C., a penetration hardness of about 70 to 120, and a transferability factor of from above 150 to less than 300, said matrix (1) and water component (D) together providing a transparent formulation.

2. A composition as defined in claim 1 wherein said fatty acids average at least 12 carbon atoms per molecule.

3. A composition as defined in claim 2 wherein component A comprises the alkali metal salts of mixtures of palmitic and stearic acids.

4. A composition as defined in claim 1 wherein at least about 40% of component B is an aliphatic non ionic detergent.

5. A composition as defined in claim 4 wherein said aliphatic non ionic detergent is a reaction product of about 2 to 50 moles of ethylene oxide with 1 mole of $C_{8-20}$ saturated aliphatic alcohol.

6. A composition as defined in claim 1 wherein said substantially water insoluble portion of component C comprises benzyl alcohol and said water soluble portion of component C comprises propylene glycol.

7. A composition as defined in claim 6 containing about equal amounts of said water insoluble and water soluble portions of component C.

8. A composition as defined in claim 7 wherein at least about 40% of component A are the alkali metal salts of hydrogenated tallow fatty acids, and at least about 40% of component B is the non ionic reaction product of about 2 to 50 moles of ethylene oxide with 1 mole of a $C_{8-20}$; saturated aliphatic alcohol.

9. A composition as defined in claim 1 further containing about 0.1 to about 5% by weight of a free alkali metal hydroxide.

10. A water soluble, soft, spreadable detergent stick having a basis of a composition as defined in claim 1.

11. A water soluble, soft spreadable stick having a basis of a composition as defined in claim 8.

* * * * *